US010743603B2

(12) United States Patent
McDavitt

(10) Patent No.: US 10,743,603 B2
(45) Date of Patent: Aug. 18, 2020

(54) CLIP-FREE HELMET VISORS

(71) Applicant: Bell Sports, Inc., Scotts Valley, CA (US)

(72) Inventor: Joel W. McDavitt, Santa Cruz, CA (US)

(73) Assignee: Bell Sports, Inc., Scotts Valley, CA (US)

( * ) Notice: Subject to any disclaimer, the term of this patent is extended or adjusted under 35 U.S.C. 154(b) by 0 days.

(21) Appl. No.: 16/041,739

(22) Filed: Jul. 21, 2018

(65) Prior Publication Data

US 2019/0059499 A1 Feb. 28, 2019

Related U.S. Application Data

(60) Provisional application No. 62/550,539, filed on Aug. 25, 2017.

(51) Int. Cl.

| | |
|---|---|
| ***A42B 3/22*** | (2006.01) |
| ***A42B 3/28*** | (2006.01) |
| *A42B 3/06* | (2006.01) |

(52) U.S. Cl.

CPC ..... *A42B 3/227* (2013.01); *A42B 3/221* (2013.01); *A42B 3/28* (2013.01); *A42B 3/066* (2013.01); *A42B 3/283* (2013.01)

(58) Field of Classification Search

CPC ..... A42B 3/28; A42B 3/221; A42B 3/227

USPC ..... 2/422

See application file for complete search history.

(56) References Cited

U.S. PATENT DOCUMENTS

| | | | | |
|---|---|---|---|---|
| 5,675,843 | A * | 10/1997 | Grim | A42B 3/227 2/12 |
| 6,170,084 | B1 * | 1/2001 | Gordon | A42B 3/227 2/12 |
| D745,224 | S * | 12/2015 | Wako | D29/122 |
| 2019/0059499 | A1 * | 2/2019 | McDavitt | A42B 3/28 |

FOREIGN PATENT DOCUMENTS

| | | | |
|---|---|---|---|
| FR | 2719749 | A1 | 11/1995 |

* cited by examiner

*Primary Examiner* — Gloria M Hale

(74) *Attorney, Agent, or Firm* — Gerard M. Donovan; Amardeep S. Grewal; Reed Smith LLP

(57) ABSTRACT

A visor removably attached to a helmet includes a brim, a first wing extending from the brim, a first prong from the first wing engaging with the first side vent. A second wing opposite the first wing extends from the brim, a second prong from the second wing engaging with the second side vent. A distance between the first prong and the second prong is smaller than a distance between the first front wall of the first side vent and the second front wall of the second side vent, the first prong and the second prong respectively engaged with the first side vent and the second side vent through tension in the visor resulting from expansion of a wingspan between the first wing and the second wing.

10 Claims, 9 Drawing Sheets

CLIP-FREE HELMET VISORS

RELATED APPLICATIONS

This application claims the benefit of U.S. provisional patent application 62/550,539, filed Aug. 25, 2017 titled "Clip-Free helmet Visors," the entirety of the disclosure of which is incorporated by this reference.

TECHNICAL FIELD

Aspects of this document relate generally to helmets and helmet visors, and more specifically to a helmet visor that removably couples to a helmet without clips.

BACKGROUND

Protective headgear and helmets have wide uses. Sometimes a helmet with a sun/rain visor is desired and sometimes it is not depending upon the user and the particular weather for the day and the particular activity.

SUMMARY

According to an aspect, a helmet may comprise a helmet body forming an energy-management liner, the helmet body comprising an outer surface, an inner surface opposite the outer surface, and a rim extending between a lower edge of each of the outer surface and the inner surface, wherein the rim comprises a first side, a second side, and a front between the first side and the second side, the helmet body further comprising a first side vent on a first side of the helmet body and a second side vent on a second side of the helmet body opposite the first side vent, the first side vent disposed through the energy-management liner adjacent the rim of the helmet body and comprising a first front wall proximate the front of the rim, the second side vent disposed through the energy-management liner and adjacent the rim of the helmet body and comprising a second front wall proximate the front of the rim, and a visor removably coupled to the helmet body, the visor may comprise a brim comprising a front facing away from the helmet body and a back facing toward the helmet body, a first wing extending from the brim and toward the first side vent, the first wing further comprising a first prong extending inwardly toward the inner surface of the helmet body, the first prong engaging with the first side vent at the first front wall of the first side vent, a second wing opposite the first wing, the second wing extending from the brim and toward the second side vent, the second wing further comprising a second prong extending inwardly toward the inner surface of the helmet body, the second prong engaging with the second side vent at the second front wall of the second side vent, wherein a distance between the first prong and the second prong is smaller than a distance between the first front wall of the first side vent and the second front wall of the second side vent, the first prong and the second prong respectively engaged with the first side vent and the second side vent through tension in the visor resulting from expansion of a wingspan between the first wing and the second wing.

Particular embodiments may comprise one or more of the following. The helmet may further comprise one or more recesses on the outer surface of the helmet and adjacent the front of the rim, and the visor further comprises one or more protrusions projecting from the back of the brim of the visor, the one or more protrusions engaging in the one or more recesses. The visor may comprise a first protrusion and a second protrusion, the first protrusion and the second protrusion disposed substantially symmetrically about a centerline of the visor. The first side vent may further comprise a bottom wall proximate the rim, and wherein the first prong extends from a top of the first wing, the first wing disposed between the bottom wall of the first side vent and the first side of the rim. A bottom of the first wing may curves toward the helmet body. An end of the first wing may follow the outer surface of the helmet.

According to an aspect, a visor for a helmet may comprise a brim comprising a front and a back opposite the front, a first wing extending from the brim and curving rearward, and a second wing opposite the first wing, the second wing extending from the brim and curving rearward, the second wing and the first wing facing each other, wherein the first wing further comprises a first prong extending from the first wing toward the second wing, the second wing further comprising a second prong extending from the second wing toward the first wing, a distance between the first prong and the second prong is smaller than a distance between a first engagement point on a first side vent and a second engagement point on a second side vent of a helmet, the first prong is configured to engage with the first engagement point on the first side vent of the helmet through a horizontal tension of the first wing caused by an expansion of a wingspan between the first wing and the second wing, and the second prong is configured to engage with the second engagement point on the second side vent of the helmet through the tension of the second wing caused by the expansion of the wingspan.

Particular embodiments may comprise one or more of the following features. The visor may further comprise one or more protrusions projecting from the back of the brim of the visor, the one or more protrusions configured to engage in one or more recesses on an outer surface of the helmet. A first protrusion and a second protrusion, the second protrusion disposed on an opposite side of a centerline of the visor from the first protrusion. The first prong may extend from a top of the first wing. A bottom of the first wing may curve toward the second wing. An end of the first wing may follow an outer surface of the helmet.

Aspects and applications of the disclosure presented here are described below in the drawings and detailed description. Unless specifically noted, it is intended that the words and phrases in the specification and the claims be given their plain, ordinary, and accustomed meaning to those of ordinary skill in the applicable arts. The inventors are fully aware that they can be their own lexicographers if desired. The inventors expressly elect, as their own lexicographers, to use only the plain and ordinary meaning of terms in the specification and claims unless they clearly state otherwise and then further, expressly set forth the "special" definition of that term and explain how it differs from the plain and ordinary meaning. Absent such clear statements of intent to apply a "special" definition, it is the inventors' intent and desire that the simple, plain, and ordinary meaning to the terms be applied to the interpretation of the specification and claims.

The inventors are also aware of the normal precepts of English grammar. Thus, if a noun, term, or phrase is intended to be further characterized, specified, or narrowed in some way, such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

Further, the inventors are fully informed of the standards and application of the special provisions of 35 U.S.C. § 112, ¶6. Thus, the use of the words "function," "means" or "step" in the Detailed Description or Description of the Drawings or claims is not intended to somehow indicate a desire to invoke the special provisions of 35 U.S.C. § 112, ¶6, to define the invention. To the contrary, if the provisions of 35 U.S.C. § 112, ¶6 are sought to be invoked to define the inventions, the claims will specifically and expressly state the exact phrases "means for" or "step for," and will also recite the word "function" (i.e., will state "means for performing the function of [insert function]"), without also reciting in such phrases any structure, material, or acts in support of the function. Thus, even when the claims recite a "means for performing the function of . . . " or "step for performing the function of . . . ," if the claims also recite any structure, material, or acts in support of that means or step, or to perform the recited function, it is the clear intention of the inventors not to invoke the provisions of 35 U.S.C. § 112, ¶6. Moreover, even if the provisions of 35 U.S.C. § 112, ¶6, are invoked to define the claimed aspects, it is intended that these aspects not be limited only to the specific structure, material, or acts that are described in the preferred embodiments, but in addition, include any and all structures, material, or acts that perform the claimed function as described in alternative embodiments or forms in the disclosure, or that are well-known present or later-developed, equivalent structures, material, or acts for performing the claimed function.

The foregoing and other aspects, features, and advantages will be apparent to those artisans of ordinary skill in the art from the DETAILED DESCRIPTION and DRAWINGS, and from the CLAIMS.

BRIEF DESCRIPTION OF THE DRAWINGS

Implementations will hereinafter be described in conjunction with the appended drawings, where like designations denote like elements, and.

DETAILED DESCRIPTION

Figure 1A:
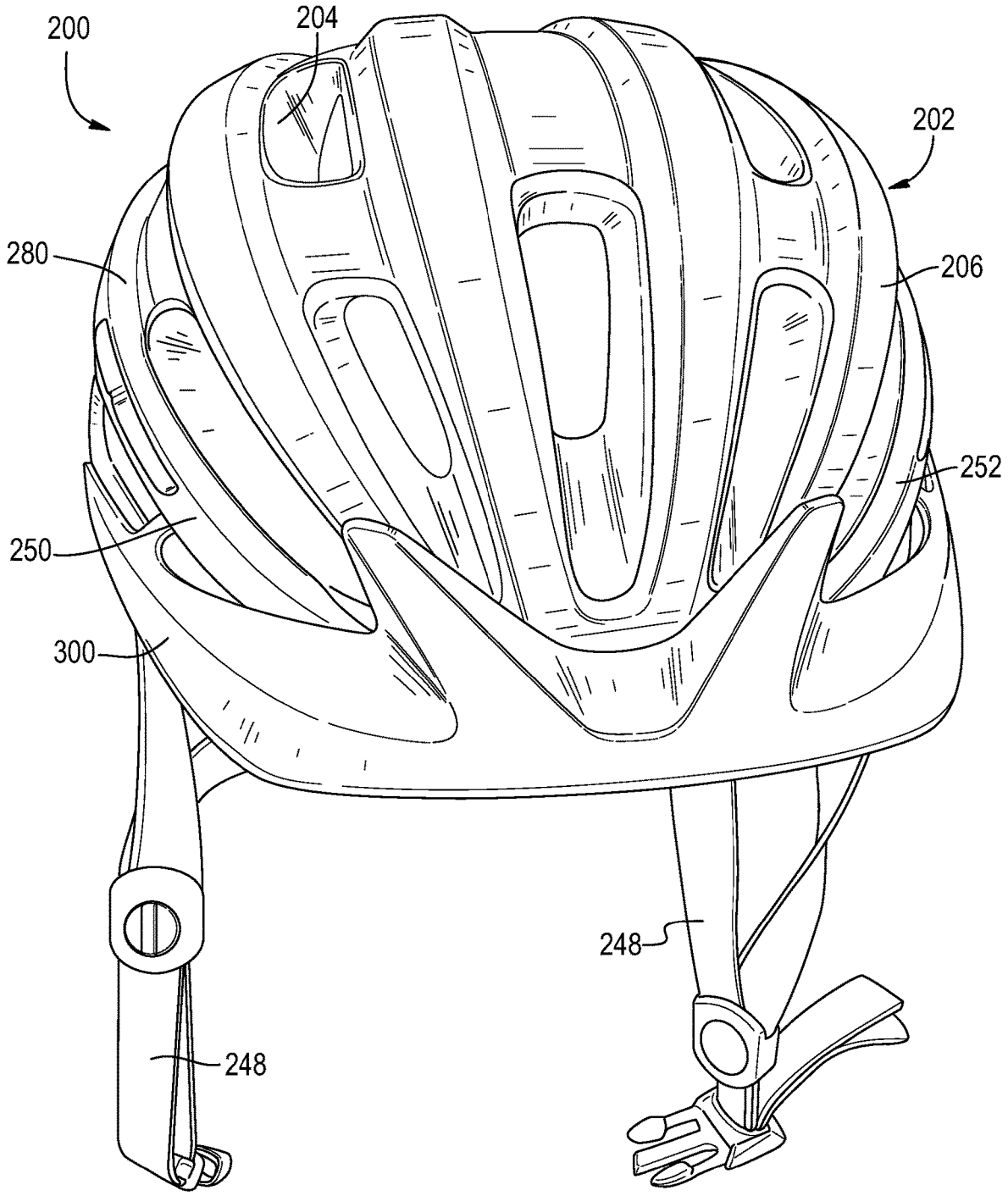
FIG. 1A is a front view of an example helmet having an example visor attached.

While this disclosure includes embodiments in many different forms, they are shown in the drawings and will herein be described in detailed particular embodiments with the understanding that the present disclosure is to be considered as an exemplification of the principles of the disclosed methods and systems and is not intended to limit the broad aspect of the disclosed concepts to the embodiments illustrated.

Protective head gear and helmets have been used in a wide variety of applications and across a number of industries including recreation, sports, athletics, construction, mining, military defense, and others, to prevent damage to users' heads and brains. Damage and injury to a user can be prevented or reduced by preventing hard objects, sharp objects, or both, from directly contacting the user's head, and also by absorbing, distributing, or otherwise managing energy of an impact between the object and the user's head. Straps or webbing are typically used to allow a wearer to releasably wear the helmet, and to ensure the helmet remains on the wearer's head during an impact.

Protective headgear or helmets can be used for a snow skier, cyclist, football player, hockey player, baseball player, lacrosse player, polo player, climber, auto racer, motorcycle rider, motocross racer, snowboarder or other snow or water athlete, sky diver, or any other athlete, recreational or professional, in a sport. Other non-athlete users such as workers involved in industry, including without limitation construction workers or other workers or persons in dangerous work environments can also benefit from the protective headgear described herein, as well as the system and method for providing the protective head gear.

Helmets function to provide protection while minimizing interference with an activity. The shape of a helmet may be adapted to provide both protection and comfort (e.g. allowing ventilation and variation of sizes). Some helmets are made of two or more bodies of energy-absorbing material formed in shapes that would be difficult, if not impossible, to achieve in a single molded piece.

Various implementations and embodiments of protective helmets according to this disclosure comprise a protective shell. The protective shell may be formed of an energy absorbing material such as expanded polystyrene (EPS), expanded polyurethane (EPU), expanded polyolefin (EPO), expanded polypropylene (EPP), or other suitable material. The energy absorbing material can be used as part of a hard-shell helmet such as skate bucket helmets, motorcycle helmets, snow sport helmets, football helmets, batting helmets, catcher's helmets, or hockey helmets, and include an additional outer protective shell disposed outside, or over, the protective shell. In hard shell applications, the energy absorbing material may comprise one or more layers of EPP and provide more flexibility. Alternatively, the energy absorbing material may be part of an in-molded helmet such as a bicycle helmet. An outer shell, such as a layer of stamped polyethylene terephthalate or a polycarbonate shell, or some other material like polyvinyl chloride (PVC) or acrylonitrile butadiene styrene (ABS), may be included on an outer surface of the protective shell of the helmet and be bonded directly to the energy management liner.

Conventional helmet visors couple to the helmet through coupling mechanisms, such as clips, flaps, clamps, pins, appendages, or plugs, which mechanically attach the visor to complementary structures installed in or on the helmet on or near the center of the visor. In addition to requiring additional parts to be installed in the helmet and requiring additional assembling steps, such visors tend to wobble and become bothersome to the wearer because the mechanical force between the coupling mechanisms and their complementary parts that hold the visor onto the helmet is localized at the center attaching points and has little effect on the rest of the visor body, particularly over time. As a result, the movements of the helmet during use cause the visor to rotate or wobble about the attachment point.

Figure 1B:
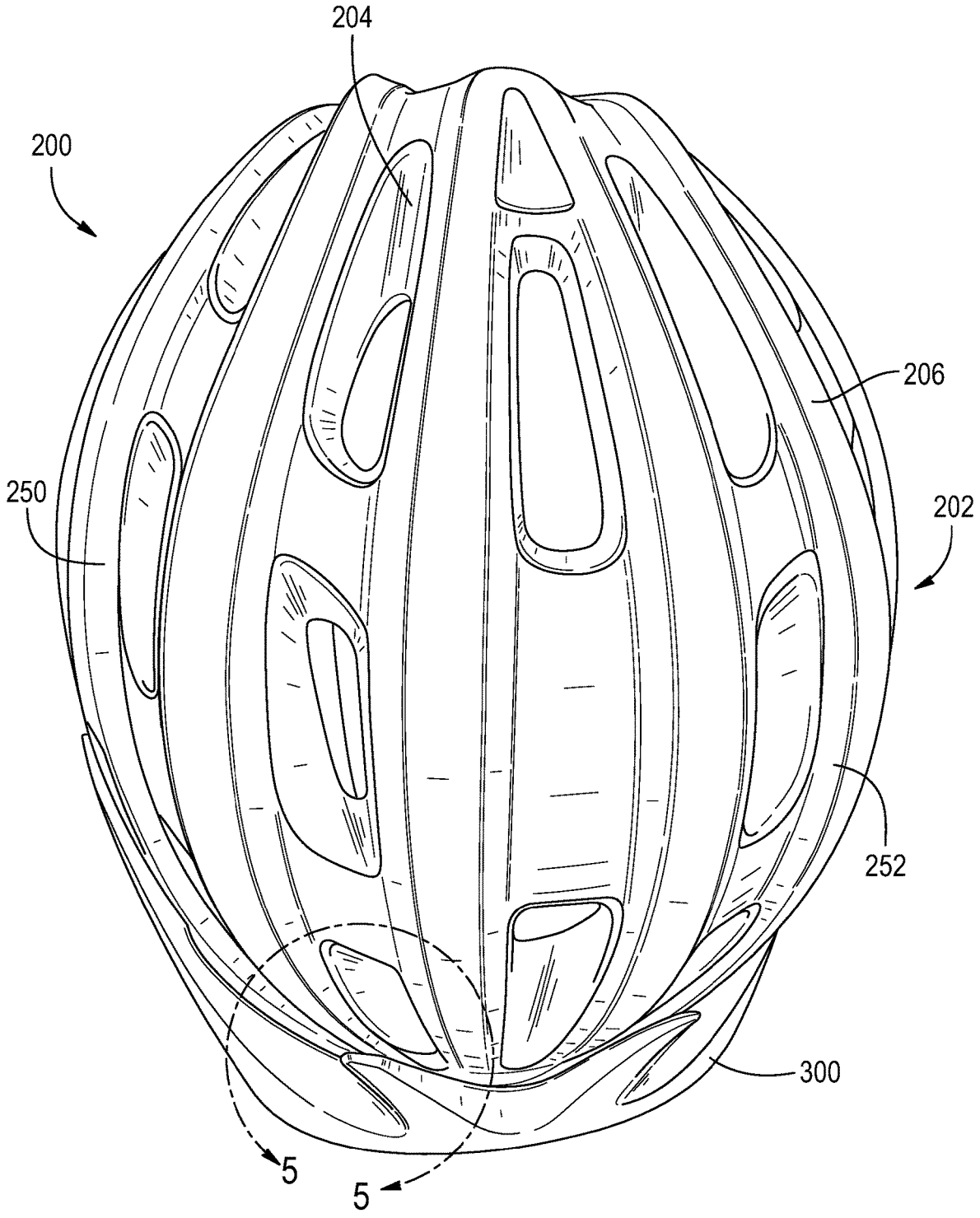
FIG. 1B is a top view of the helmet of FIG. 1A.
Figure 1C:
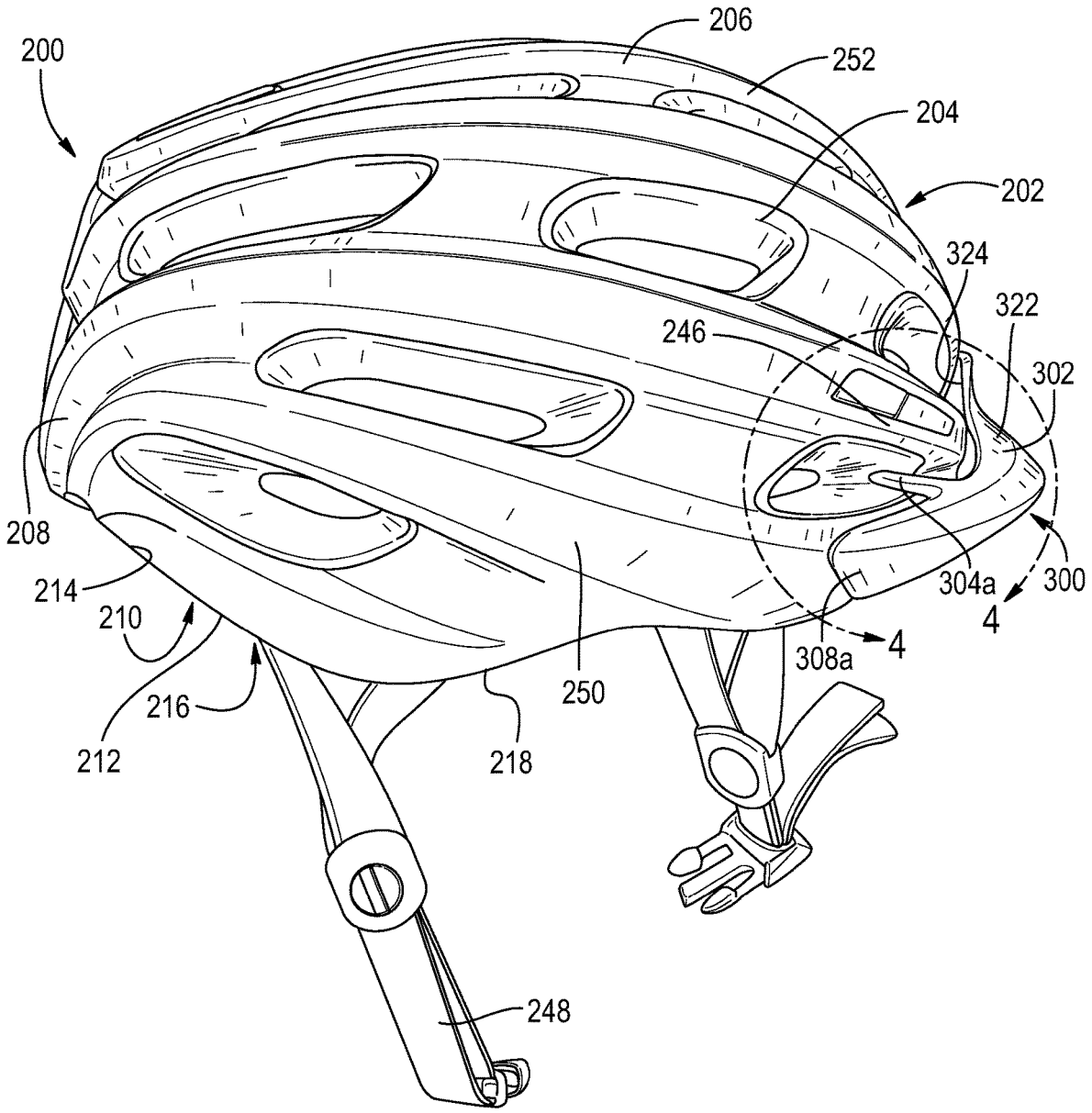
FIG. 1C is a side view of the helmet of FIG. 1A.

The present disclosure relates to a visor that can be attached to a helmet without the requirements of any additional parts being installed in the helmet. Further, the visor embodiments disclosed herein stay on the helmet and do not wobble during riding because of the horizontal tension exerted across the visor body by the wings of the visor. FIGS. 1A-1C illustrate front, top, and side views of a helmet 200 with a visor 300 attached. FIGS. 2A-2D illustrate the top, front, side, and side perspective views of the helmet 200 and the visor 300, where the visor 300 is detached from the helmet body 202.

A helmet 200 comprises a helmet body 202 (FIGS. 1A-2C). The helmet 200 may further comprise a fit system 248, which is used to help fit the helmet 200 onto a wearer's head. The helmet body 202 comprises at least one energy-management liner 204 to absorb a portion of the impact forces to the wearer's head from collisions. The helmet body 202 may further comprise an outer shell 206 around all or a portion of the liner 204. The helmet 200 comprises an outer surface 208 and an inner surface 210 opposite the outer surface 208. The helmet 200 further comprises a rim 212 extending between the lower edge 214 of the outer surface 208 and the lower edge 216 of the inner surface 210 (FIG. 1C). The rim 212 comprises a first side 218, a second side 220 opposite the first side 218, and a front 222 positioned between the first side 218 and the second side 220 (FIG. 2A).

Figure 4:
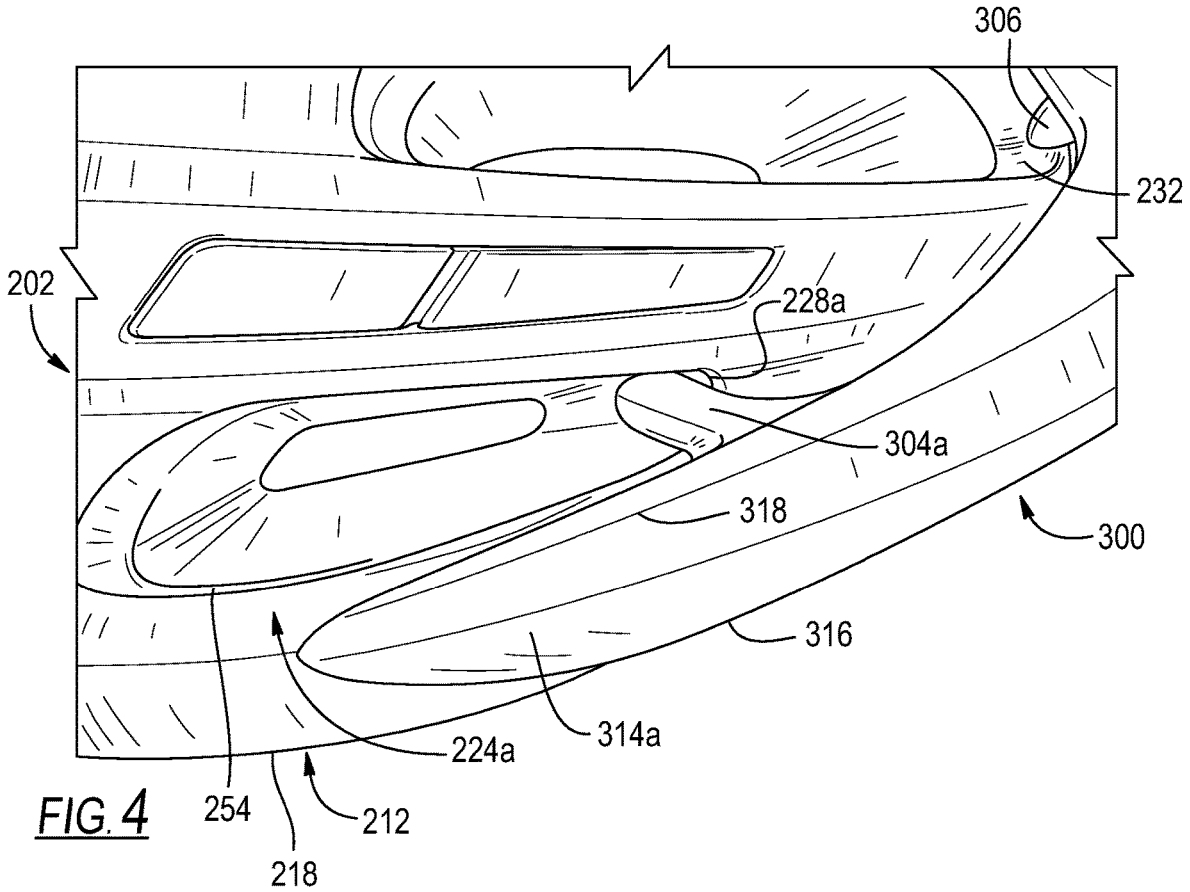
FIG. 4 is a close-up view of a portion of the helmet of FIG. 1C taken at section lines 4-4.

A helmet conventionally has multiple vents distributed on the outer surface or through the helmet body to allow for air flow into and/or out of the helmet. In the embodiment illustrated in FIGS. 1A-2D, the helmet 200 further comprises a first side vent 224*a* and a second side vent 224*b*. The first and second side vents 224*a*, 224*b* are disposed on the first or second side 250, 252 of the helmet body 202 above the first side 218 or the second side 220 of the rim 212, where the second side 252 of the helmet body 202 is opposite the first side 250 of the helmet body 202. The first and second side vents 224*a*, 224*b* may be disposed along the rim 212 of the helmet 200. The first and second side vents 224*a*, 224*b* comprise a first or second front wall 228*a*, 228*b* proximate the front 222 of the rim 212 and a bottom wall 254 proximate the side 218, 220 of the rim 212. FIG. 4 shows a close-up view of the first side vent 224*a* with a first prong 304*a* engaged with the front wall 228*a* of the first side vent 224*a*. The second side vent 224*b* may be a mirror image of the first side vent 224*a* disposed above the second side 220 of the rim 212, with a second prong 304*b* engaged with the front wall 228*b* of the second side vent 224*b*. The helmet body 202 may further comprise a recess 232 in the front portion 246 of the helmet body 202 disposed above the front 222 of the rim 212 (FIGS. 2C-2D).

Figure 3A:
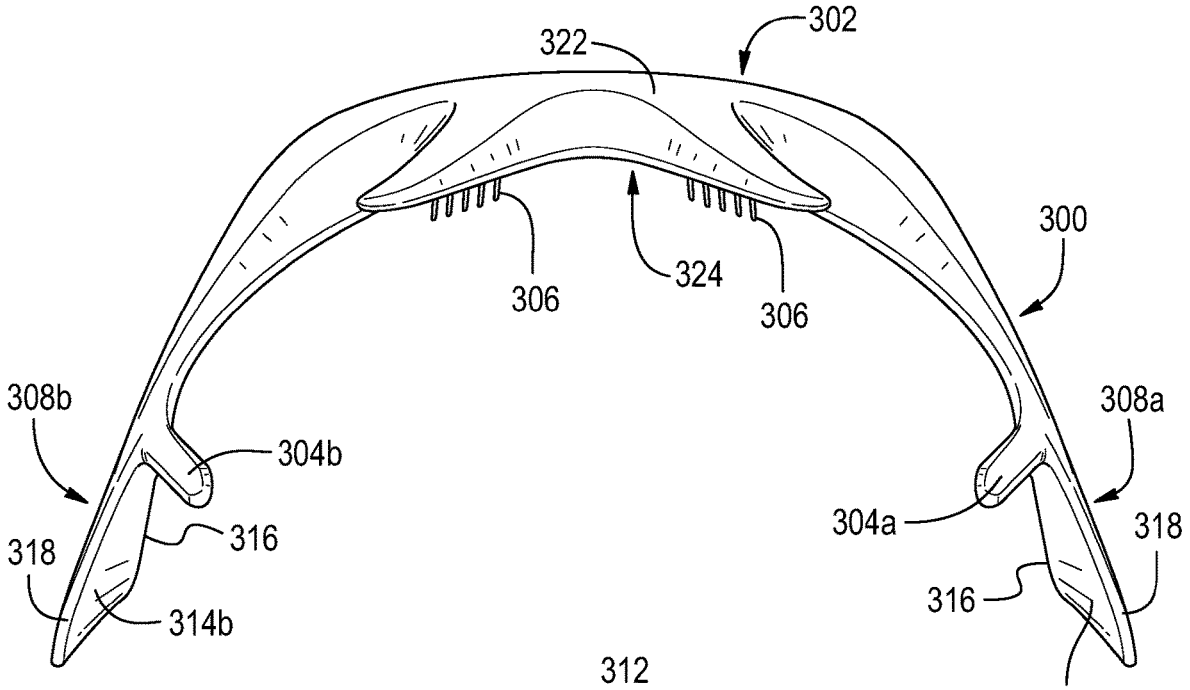
FIG. 3A is a top view of an example visor.
Figure 3B:
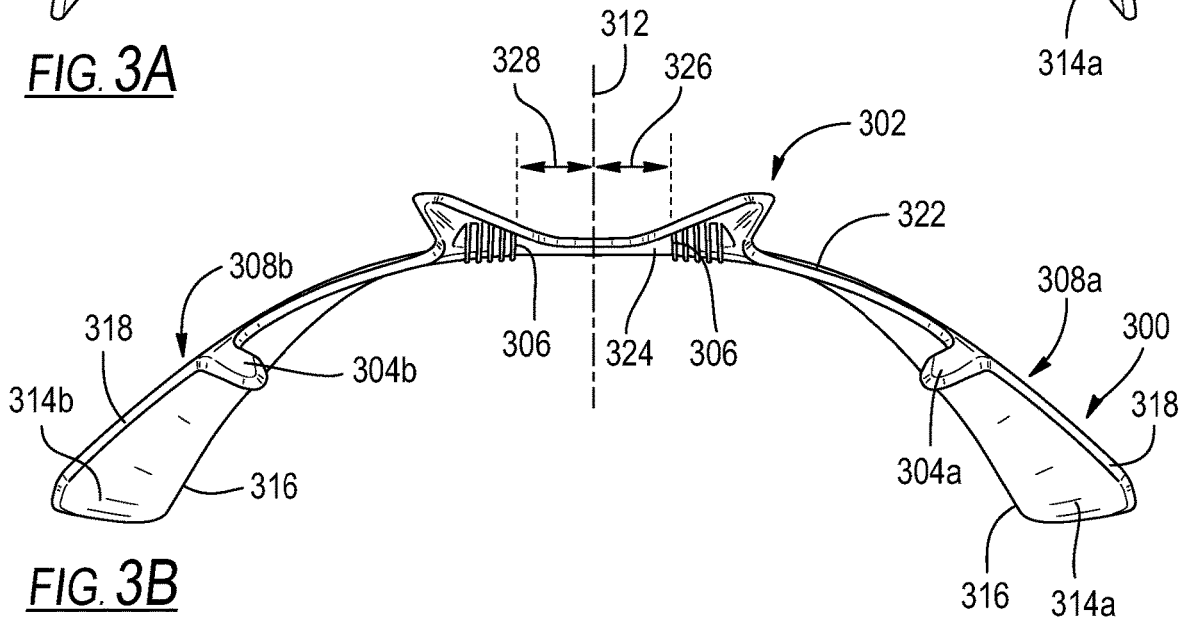
FIG. 3B is a rear view of the visor of FIG. 3A.
Figure 3C:
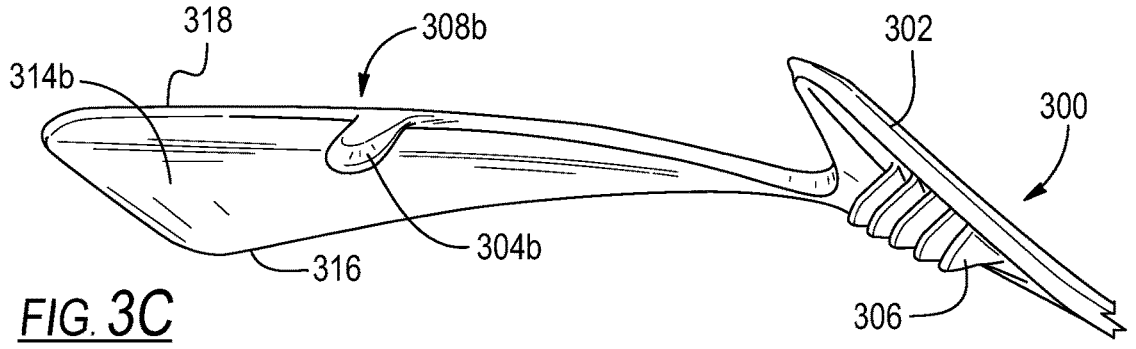
FIG. 3C is a partial view of the visor of FIG. 3A.

The helmet 200 may further comprise a visor 300 that removably couples to the helmet body 202. FIGS. 3A-3B illustrate the top, rear, and perspective views of an example visor 300 of the present disclosure, by itself. FIG. 3C shows a close-up view of the second wing 308*b* of the visor 300. The first wing 308*a* is a mirror image of the second wing 308*b*.

A visor 300 comprises a brim 302, a first wing 308*a*, and a second wing 308*b* (FIGS. 3A-3C). The brim 302 comprises a front 322, and a back 324 opposite the front 322. When the visor 300 is placed on the helmet body 202, the front 322 of the visor 300 faces away from the helmet body 202 and the back 324 of the visor 300 faces toward the helmet body 202 (FIGS. 1C and 2C). The first and second wings 308*a*, 308*b* extend from the brim 302 and curve rearward to approximately match the shape of the outer surface 208 of the helmet where the first and second wings 308*a*, 308*b* overlay the outer surface 208 when the visor 300 is attached to the helmet. The first and second wings 308*a*, 308*b* may face each other. When the visor 300 is placed on the helmet body 202, the first and second wings 308*a*, 308*b* curve toward the first and second side vents 224*a*, 224*b*. The brim 302 extends forward so that the visor 300 can be used to block sun light, bright light, or rain.

The visor 300 further comprises a first prong 304*a* and a second prong 304*b* (FIGS. 3A-3C). The first prong 304*a* extends from the first wing 308*a* toward the second wing 308*b*. The second prong 304*b* extends from the second wing 308*b* toward the first wing 308*a*. When the visor 300 is placed on the helmet body 202, the prong 304*a*, 304*b* extends inwardly toward the inner surface 210 of the helmet body 202 (FIG. 1C). The prong 304*a*, 304*b* may extend from the top 318 of the wing 308*a*, 308*b*. The bottom 316 of the wing 308*a*, 308*b* may curve inward and closer to the centerline 312 of the visor 300 than the top 318 of the wing 308*a*, 308*b* so that the wing 308*a*, 308*b* closely fits on the outer side surface of the helmet 200 and hold onto the helmet body 202 (FIGS. 2A-2B).

Figure 2A:
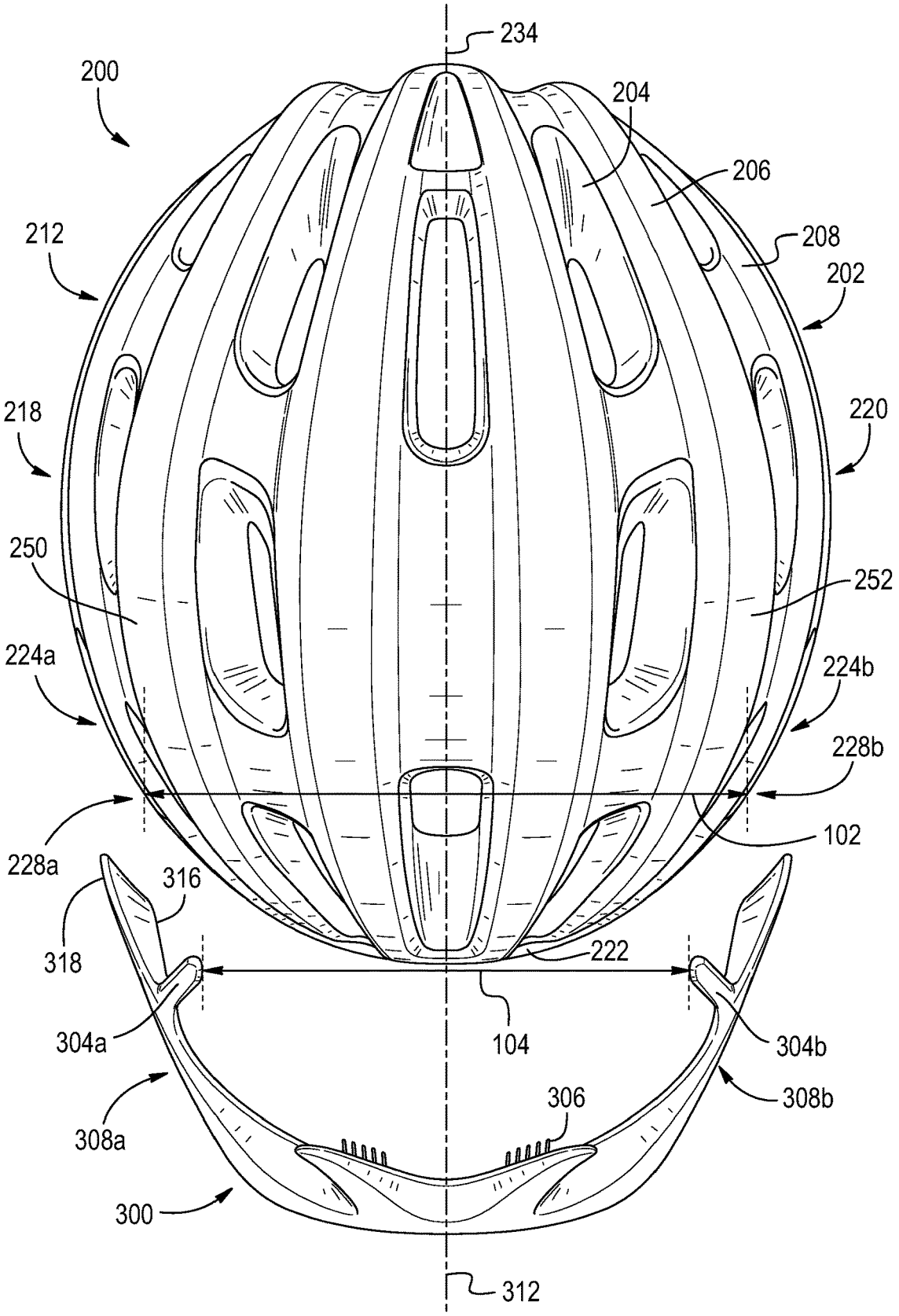
FIG. 2A is a top view of the helmet of FIG. 1A with the visor detached from the helmet body.
Figure 2B:
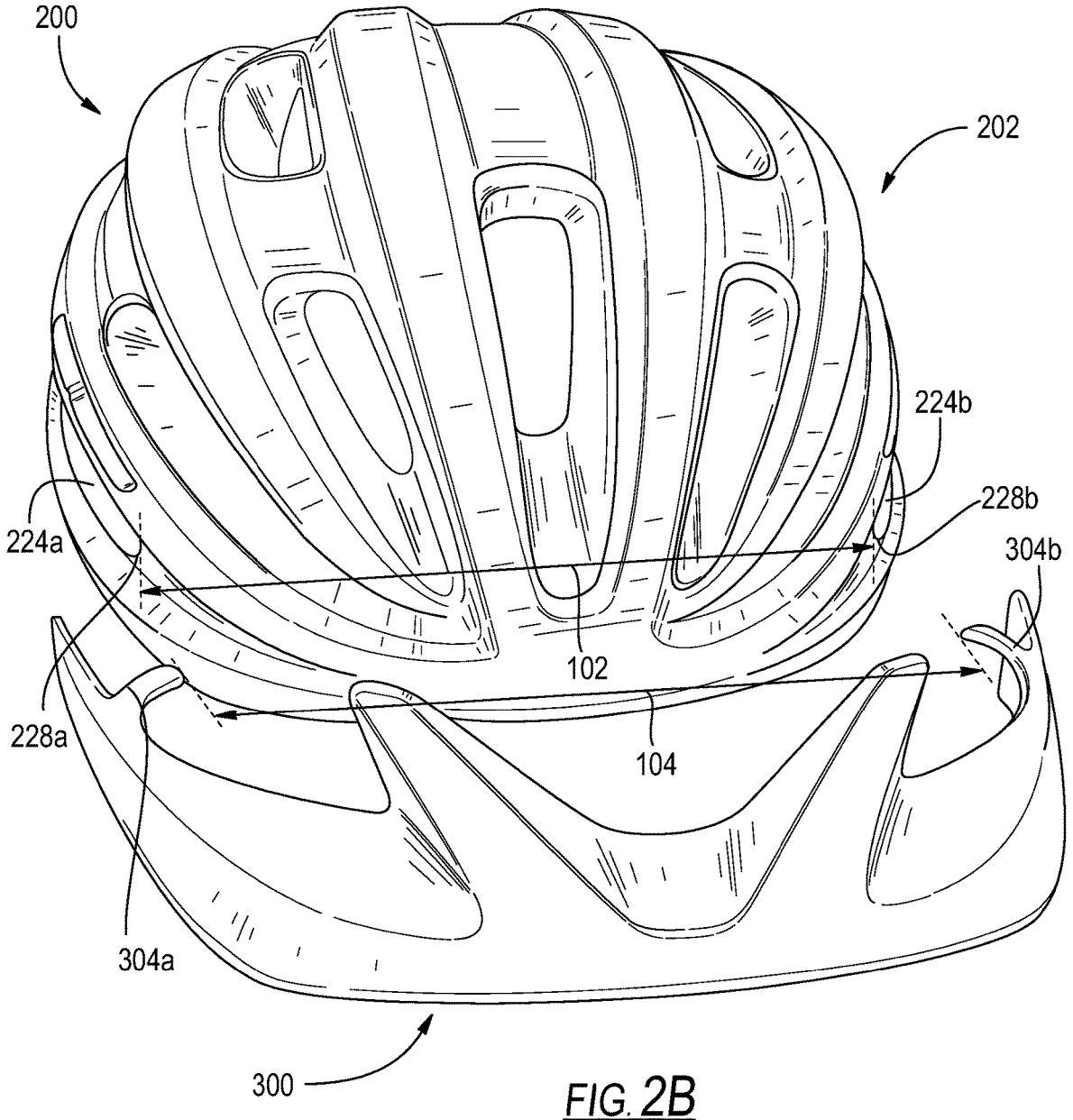
FIG. 2B is a front view of the helmet and visor of FIG. 2A.
Figure 2C:
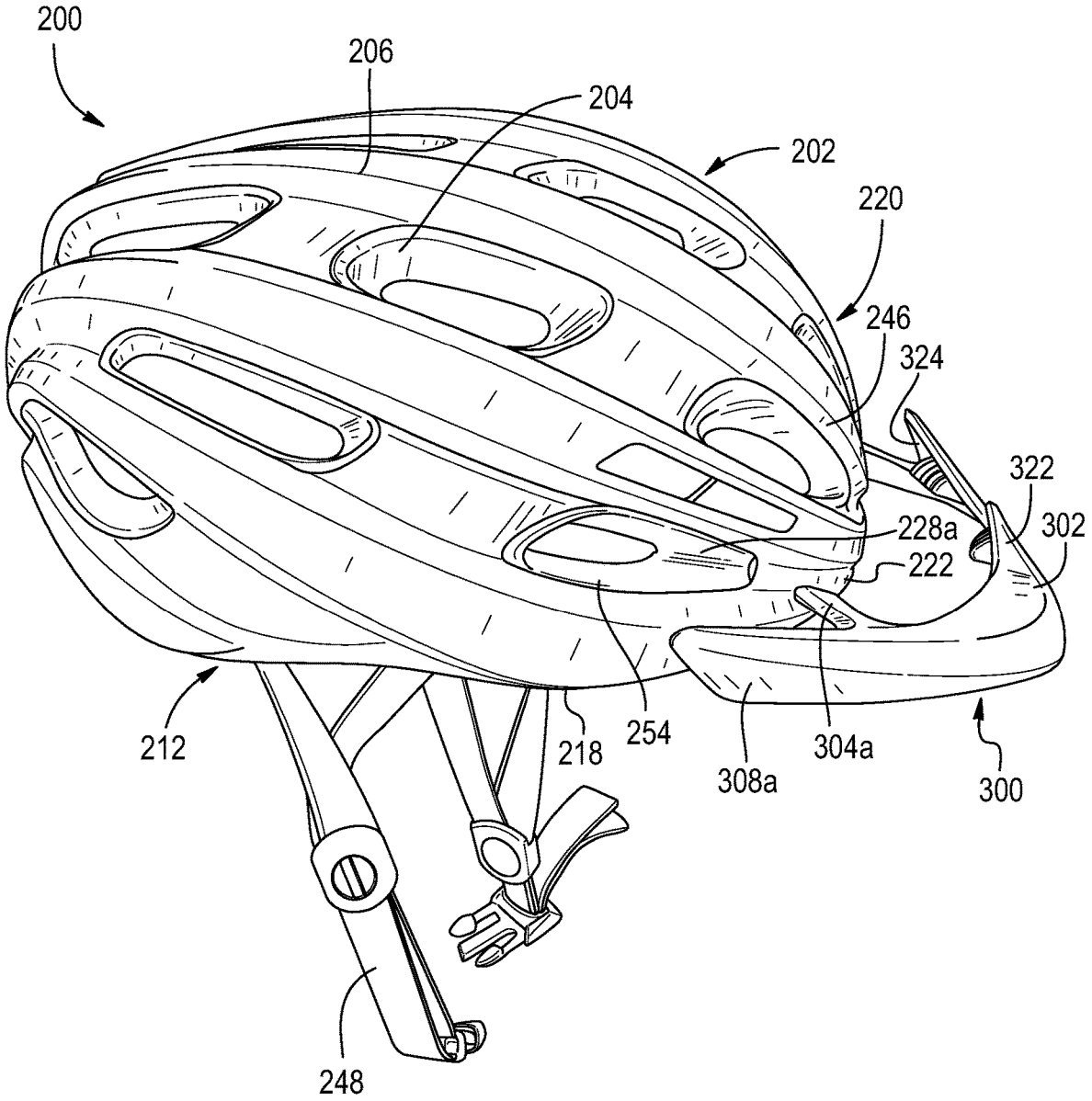
FIG. 2C is a side view of the helmet and visor of FIG. 2A.
Figure 2D:
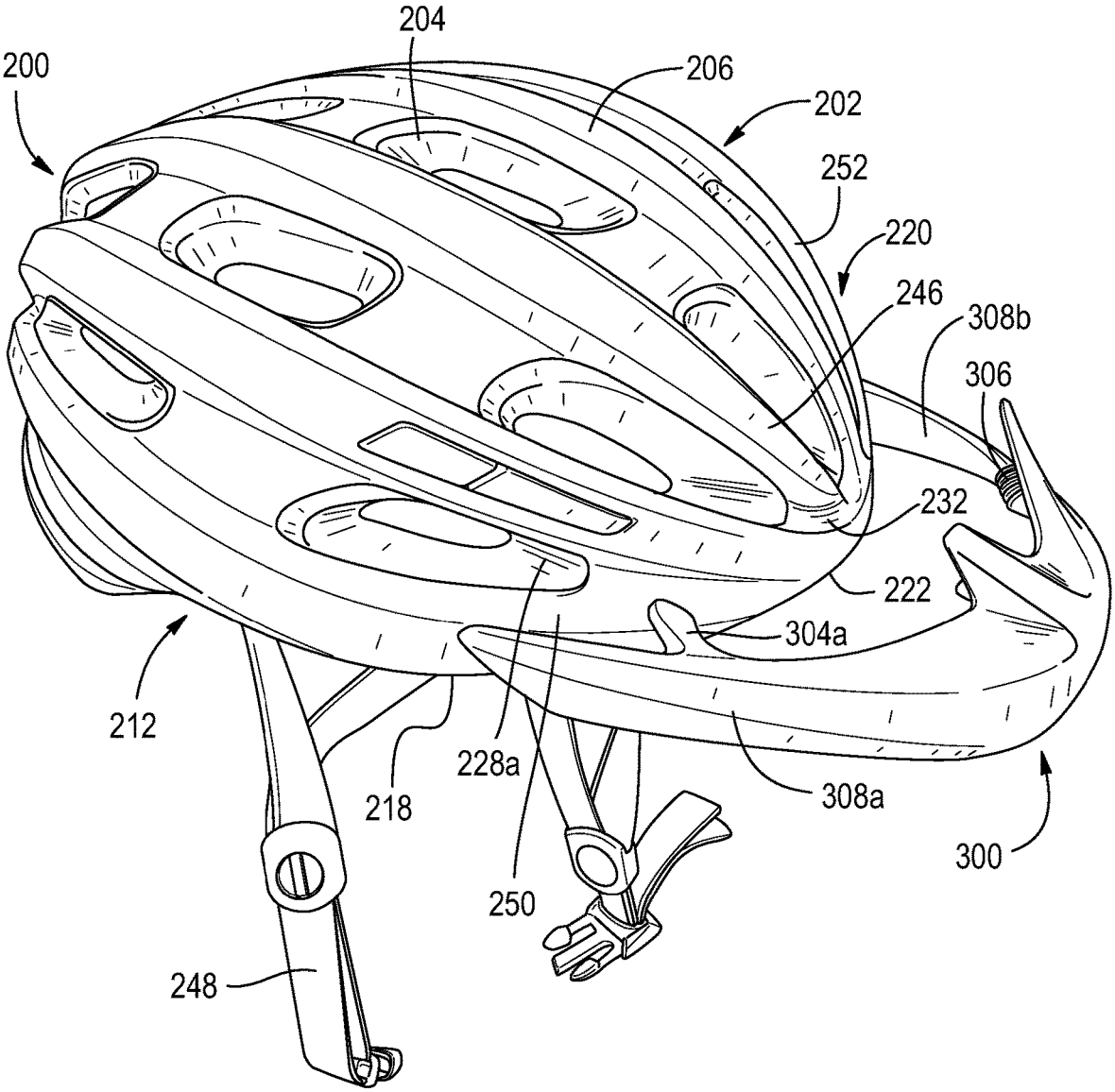
FIG. 2D is a side perspective view of the helmet and visor of 2A.

The distance 104 between the two prongs 304*a*, 304*b* or the wingspan of the visor are substantially equal to or smaller than the distance 102 between the front walls 228*a*, 228*b* of the two side vents 224*a*, 224*b* of the helmet 200 (FIGS. 2A-2B). The wingspan of the visor is measured as the distance between a point on the first prong 304*a* and a point on the second prong 304*b*. In some embodiments, the wingspan 104 of the visor 300 is measured as the distance between the inner-most tip of the first prong 304*a* and the inner-most tip of the second prong 304*b* and the distance 102 between the front walls 228*a*, 228*b* is measured as the distance between the front edges of the front walls 228*a*, 228*b* (FIGS. 2A-2B). Two distances are substantially equal to each other when the difference between them is in the ranged of 0-1 cm, 0-2 cm, or 0-3 cm. This smaller dimension of the wingspan 104 of the visor 300 relative to the distance 102 between the front walls 228*a*, 228*b* of the side vents 224*a*, 224*b* causes the wings 308*a*, 308*b* to exert a horizontal tension upon the visor and the prongs 304*a*, 304*b* to engage in the side vents 224*a*, 224*b* due to wings 308*a*, 308*b* being pulled further apart from their resting state when the visor 300 is placed on the helmet 200. The resting state of the visor 300 wings 308*a*, 308*b* is when it is not attached to the helmet.

FIG. 4 illustrates the prong 304*a* engaging the front wall 228*a* of the side vent 224*a*. This state of tension for the wings when the visor is mounted to the helmet holds the visor in place and better withstands the movements of the helmet even during use, such as during an intensive bicycle ride, than a conventional helmet that is only mounted about the center or is clipped in on the wings.

The brim 302 and the first and second wings 308*a*, 308*b* may conform to the shape of the front portion 246 and the first and second sides 250, 252 of the helmet body 202, without covering the vents, and help guide airflow to and out of the vents (FIGS. 1C and 2C). The ends 314*a*, 314*b* of the wings 308*a*, 308*b* may follow the outer surface 208 of the helmet 200 (FIG. 4). In some embodiments, the wings 308*a*, 308*b* of the visor 300 are disposed between the bottom wall 254 of the side vent 224*a*, 224*b* and the side 218, 220 of the rim 212 when the visor 300 is placed on the helmet body 202 (FIG. 4). As a result, the visor 300 does not block the side vent 224*a*, 224*b* or interfere with the function of the side vent 224*a*, 224*b*.

Figure 5:
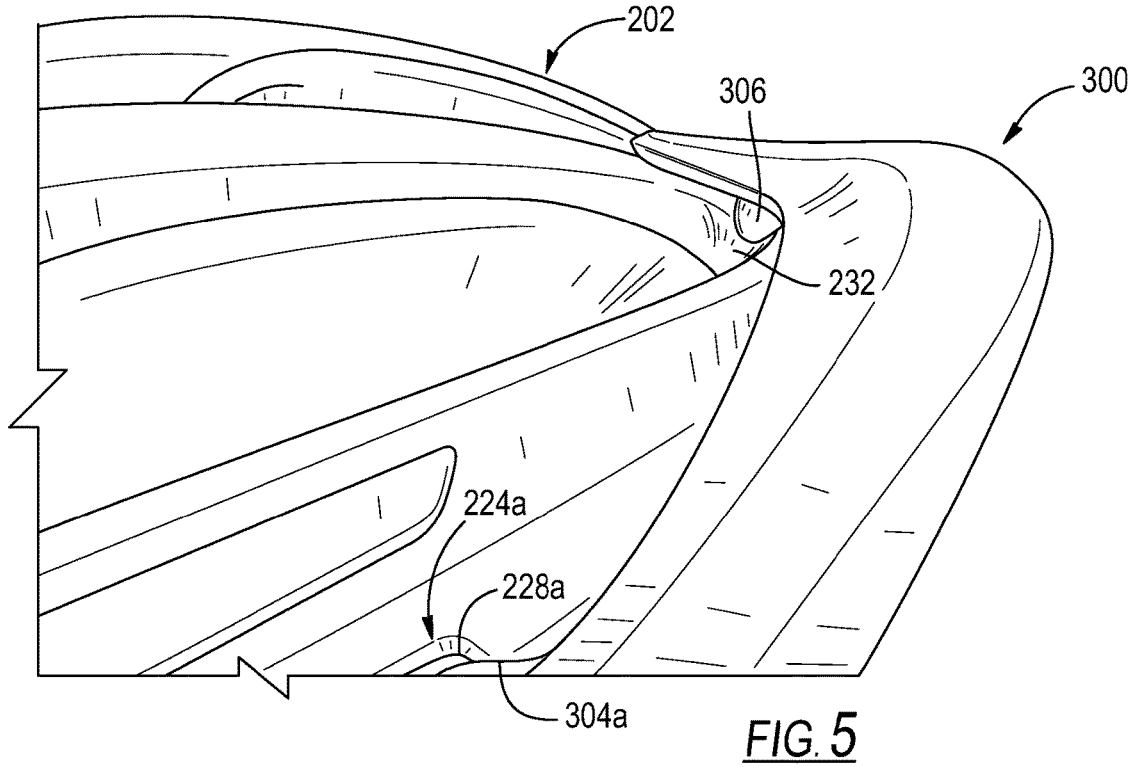
FIG. 5 is a close-up view of a portion of the helmet of FIG. 1B taken at section lines 5-5.

The visor 300 may further comprise one or more protrusions 306 extending rearward from the back 324 of the brim 302 (FIGS. 3B-3C). The protrusions 306 may be positioned on or near the center of the visor 300. The protrusions 306 may be in groups. The protrusions 306 or groups of protrusions 306 may be in pairs to balance the forces on the left and right sides of the visor. The visor 300 may comprise a first protrusion 306*a* and a second protrusion 306*b*. The second protrusion 306*b* may be disposed on an opposite side of the centerline 312 from the first protrusion 306*a*. The second protrusion 306*b* may be substantially symmetrical to the first protrusion 306*a* about the centerline 312 of the visor 300. The second protrusion 306*b* is disposed substantially symmetrical to the first protrusion 306*a* about the centerline 312 when the distance 328 between the second protrusion 306*b* and the centerline 312 is within ±0-1 cm, ±0-0.5 cm, or ±0-0.8 cm of the distance 326 between the first protrusion 306*a* and the centerline 312 (FIG. 3B). When the visor 300 is placed on the helmet body 202, the protrusions 306 rest in the recess 232 located in the front of the helmet and further restrain the visor 300 from moving up and down (FIG. 5) through mechanical interference or engagement between the surface of the helmet 200 and the protrusions 306 fitted into the recesses 232 on the surface of the helmet 200. Those recesses may be specifically positioned to mate with the protrusions on the visor or may be part of the helmet design, such as an entrance to an air vent or design line on the helmet.

The visor may be made of material, such as metal, fiber glass, or hard plastic, that holds the form of the visor and provides pliability so that the wings can be pulled further part to slide the prongs into the openings of the side vents of the helmet, and thus fit the visor onto the helmet.

The visor 300 from its rest position (FIG. 2A) may be attached to the helmet 200 by spreading the wings 308*a*, 308*b* wider than the entrance to the two side vents 224*a*, 224*b* to which the visor 300 is going to be attached (FIG. 2B). The brim 302 is then moved toward the front 222 of the helmet and the wings 308*a*, 308*b* until the prongs 304*a*, 304*b* are adjacent the side vents 224*a*, 224*b* to which they will engage (FIG. 1C). Then the wings 308*a*, 308*b*, and their corresponding prongs 304*a*, 304*b* are allowed to move closer together and engage the side vents 224*a*, 224*b*, but the visor 300 remains in a state of horizontal tension so that the prongs 304*a*, 304*b* maintain pressure against the side vents 224*a*, 224*b* (FIG. 1B). A portion of the center of the visor 300, such as the one or more protrusions 306 (if present) extending rearward from the back 324 of the brim 302, may rest upon or, in some embodiments, may engage recesses in the outer surface 206 of the helmet 200 (FIG. 5) to stabilize the center of the visor 300. The combination of the horizontal tension of the visor 300 and the stabilized center of the visor 300 may provide less wobbling and retention of the visor 300 on the helmet 200.

To pull the visor 300 off the helmet 200, the brim 302 is pulled away from the helmet or the wings 308*a*, 308*b* are pulled outward so that the prongs 308*a*, 308*b* disengage from the side vents 224*a*, 224*b*. The length of the prongs 308*a*, 308*b* is limited by the depth of the vent 224*a*, 224*b* so that the prongs 308*a*, 308*b* do not extend all the way through the vent 224*a*, 224*b* and are not in contact with the wearer's head to avoid discomfort or injury to the wearer when the visor 300 is placed on the helmet 200.

The visor embodiments disclosed herein does not require any additional parts to be installed in the helmet or any additional manufacturing process to assemble the additional parts into the helmet. In fact, embodiments of the visor are specifically designed so that the helmet looks like it does not include a visor (no clips to receive the visor and no unusual parts on the helmet) until the visor is attached to the helmet. The visor can be easily attached onto the helmet by being slid onto the helmet and easily removed from the helmet by pulling the brim or pulling the wings apart. Further, unlike conventional visors, where the additional parts change the appearance of the helmet, weaken the energy management liner, and extend through or have the potential to be pushed through the helmet and cause injury to the wearer's head if a strong impact occurs, the visors disclosed herein do not require any such additional parts or have such negative effects. In addition, neither the prongs nor the protrusions extend through the energy management liner or into the head form for the helmet. The visor disclosed herein therefore does not compromise the performance or appearance of the helmet.

This disclosure, its aspects and implementations, are not limited to the specific components or assembly procedures disclosed herein. Many additional components and assembly procedures known in the art consistent with the intended helmets and visors will become apparent for use with implementations of the apparatus and methods in this disclosure. In places where the description above refers to particular implementations of protective helmets, it should be readily apparent that a number of modifications may be made without departing from the spirit thereof and that these implementations may be applied to other protective helmets. The presently disclosed implementations are, therefore, to be considered in all respects as illustrative and not restrictive, the scope of the disclosure being indicated by the appended claims rather than the foregoing description. All changes that come within the meaning of and range of equivalency of the description are intended to be embraced therein. Accordingly, for example, although particular helmets and visors are disclosed, such apparatus, methods, and implementing components may comprise any shape, size, style, type, model, version, class, grade, measurement, concentration, material, quantity, the like as is known in the art for such apparatus, methods, and implementing components, and/or the like consistent with the intended operation of the helmet and visor may be used.

The word "exemplary," "example," or various forms thereof are used herein to mean serving as an example, instance, or illustration. Any aspect or design described herein as "exemplary" or as an "example" is not necessarily to be construed as preferred or advantageous over other aspects or designs. Furthermore, examples are provided solely for purposes of clarity and understanding and are not meant to limit or restrict the disclosed subject matter or relevant portions of this disclosure in any manner. It is to be appreciated that a myriad of additional or alternate examples of varying scope could have been presented but have been omitted for purposes of brevity.

The invention claimed is:

1. A helmet comprising:

a helmet body forming an energy-management liner, the helmet body comprising an outer surface, an inner surface opposite the outer surface, a rim extending between a lower edge of each of the outer surface and the inner surface and comprising a first side, a second side, and a front between the first side and the second side, and one or more recesses on the outer surface of the helmet and adjacent the front of the rim, the helmet body further comprising a first side vent on a first side of the helmet body and a second side vent on a second side of the helmet body opposite the first side vent, the first side vent disposed through the energy-management liner adjacent the rim of the helmet body and comprising a first front wall proximate the front of the rim, the second side vent disposed through the energy-management liner and adjacent the rim of the helmet body and comprising a second front wall proximate the front of the rim; and a visor removably coupled to the helmet body, the visor comprising:

a brim comprising a front facing away from the helmet body and a back facing toward the helmet body;

a first wing extending from the brim and toward the first side vent, the first wing further comprising a first prong extending inwardly toward the inner surface of the helmet body, the first prong engaging with the first side vent at the first front wall of the first side vent;

a second wing opposite the first wing, the second wing extending from the brim and toward the second side vent, the second wing further comprising a second prong extending inwardly toward the inner surface of the helmet body, the second prong engaging with the second side vent at the second front wall of the second side vent; and one or more protrusions projecting from the back of the brim of the visor, the one or more protrusions engaging in the one or more recesses;

wherein a distance between the first prong and the second prong is smaller than a distance between the first front wall of the first side vent and the second front wall of the second side vent, the first prong and the second prong respectively engaged with the first side vent and the second side vent through tension in the visor resulting from expansion of a wingspan between the first wing and the second wing.

2. The helmet of claim 1, wherein the visor comprises a first protrusion and a second protrusion, the first protrusion and the second protrusion disposed substantially symmetrically about a centerline of the visor.

3. The helmet of claim 1, wherein the first side vent further comprises a bottom wall proximate the rim, and wherein the first prong extends from a top of the first wing, the first wing disposed between the bottom wall of the first side vent and the first side of the rim.

4. The helmet of claim 1, wherein a bottom of the first wing curves toward the helmet body.

5. The helmet of claim 4, wherein an end of the first wing follows the outer surface of the helmet.

6. A visor for a helmet, comprising:

a brim comprising a front and a back opposite the front;

a first wing extending from the brim and curving rearward;

a second wing opposite the first wing, the second wing extending from the brim and curving rearward, the second wing and the first wing facing each other; and one or more protrusions projecting from the back of the brim of the visor, the one or more protrusions configured to engage in one or more recesses on an outer surface of the helmet;

wherein the first wing further comprises a first prong extending from the first wing toward the second wing, the second wing further comprising a second prong extending from the second wing toward the first wing, a distance between the first prong and the second prong is smaller than a distance between a first engagement point on a first side vent and a second engagement point on a second side vent of a helmet, the first prong is configured to engage with the first engagement point on the first side vent of the helmet through a horizontal tension of the first wing caused by an expansion of a wingspan between the first wing and the second wing, and the second prong is configured to engage with the second engagement point on the second side vent of the helmet through the tension of the second wing caused by the expansion of the wingspan.

7. The visor of claim 6, wherein the visor comprises a first protrusion and a second protrusion, the second protrusion disposed on an opposite side of a centerline of the visor from the first protrusion.

8. The visor of claim 6, wherein the first prong extends from a top of the first wing.

9. The visor of claim 6, wherein a bottom of the first wing curves toward the second wing.

10. The visor of claim 9, wherein an end of the first wing follows an outer surface of the helmet.

* * * * *